United States Patent [19]

Azzopardi

[11] 4,062,082

[45] Dec. 13, 1977

[54] UNDERCOUNTER POTS AND PANS WASHER

[76] Inventor: Charles M. Azzopardi, 1039 Victory Blvd., Staten Island, N.Y. 10301

[21] Appl. No.: 698,158

[22] Filed: June 21, 1976

[51] Int. Cl.[2] ..... A46B 13/02

[52] U.S. Cl. ..... 15/28; 51/170 T; 74/199; 74/405; 74/417

[58] Field of Search ..... 15/22, 23, 24, 28, 29, 15/97 R; 51/170 R, 170 PT, 170 T, 171; 32/59; 310/78, 50; 74/199, 405, 417

[56] References Cited

U.S. PATENT DOCUMENTS

| | | | |
|---|---|---|---|
| 766,182 | 8/1904 | Hale | 15/23 |
| 2,051,270 | 8/1936 | Palla | 15/28 |
| 2,202,299 | 5/1940 | Pelkey | 15/28 X |
| 2,904,804 | 9/1959 | Odessey | 15/23 X |
| 2,944,271 | 7/1960 | Foster et al. | 15/28 |
| 3,024,883 | 3/1962 | Eriksson | 15/28 X |
| 3,312,994 | 4/1967 | Fassio | 15/28 X |

*Primary Examiner*—Edward L. Roberts
*Attorney, Agent, or Firm*—Richard L. Miller

[57] ABSTRACT

A kitchen tool for being installed in a kitchen sink, counter, cabinet, the tool serving to scrub pots and pans while being washed, the tool being powered by an electric motor so to eliminate manual labor, and the tool including a chuck for selectively being fitted with interchangeable scrubbing brushes so to suit more coarse or fine scrubbing or shaped to fit different types of pots and pans.

2 Claims, 4 Drawing Figures

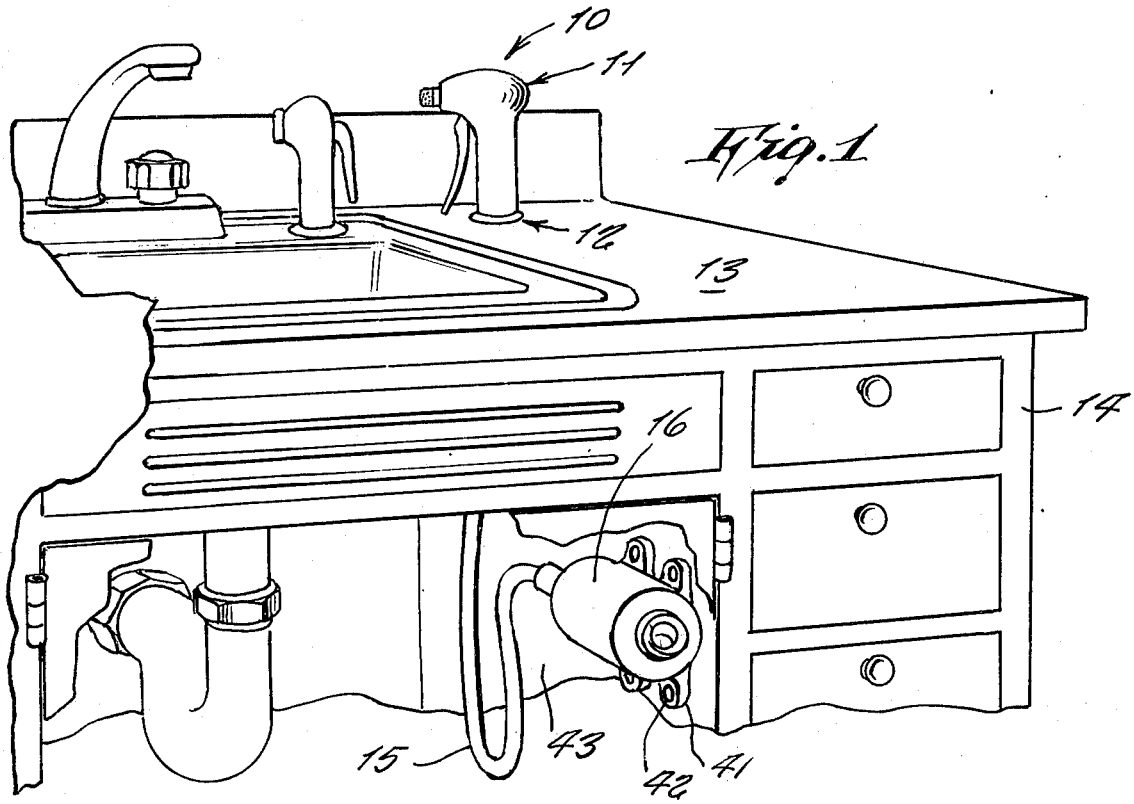
Fig. 1
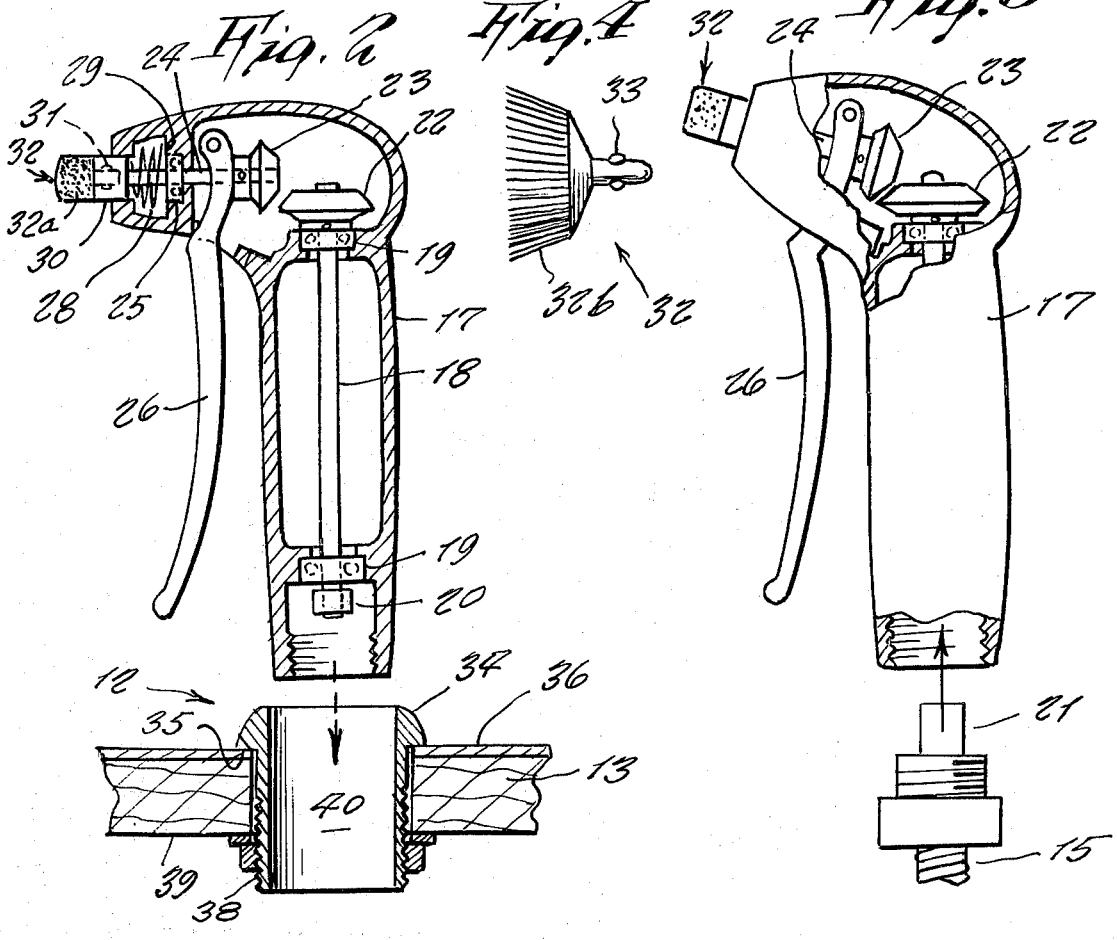

UNDERCOUNTER POTS AND PANS WASHER

This invention relates generally to kitchen electrical applicances. More specifically it relates to scrubbing devices.

It is well known to most homemakers that the scrubbing of charred foods from pots and pans is sometimes a difficult and laborous chore. Heretofore such task has always been done by hand so that it is unpleasant, and can result in bruising the knuckles or breaking of finger nails. This situation is of course objectionable and is therefore in want of an improvement.

Therefore it is a principal object of the present invention to provide a kitchen tool which removes the drudgery from pot and pan scrubbing by being electric driven.

Another object is to provide a kitchen tool which includes interchangeable scrubbing brushes so to readily fit into corners of any shape of pots and pans.

Still another object is to provide a kitchen tool which is held in one hand and operated on or off by squezing a lever, while the other hand is free to hold the pot or pan that is being scrubbed.

Yet a further object is to provide a kitchen tool that can be readily installed on a kitchen sink counter by any person having only a modest mechanical skill.

Further objects of the invention will appear as the decription proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

FIG. 1 is a perspective view of the invention shown installed on a kitchen sink.

FIG. 2 is a cross sectional view thereof.

FIG. 3 is a similar view of a slightly modified design thereof.

FIG. 4 is an alternate scrubbing brush attachable thereto.

Reference is now made to the drawing in detail wherein the reference numeral 10 represents an undercounter pots and pans washer according to the present invention wherein the same includes a hand-held unit 11 that can be stored in a receptacle 12 mounted upon a countertop 13 of a kitchen sink cabinet 14. The hand-held unit is removable from the receptacle in order to be used, the unit being connected by a flexible shaft 15 to an electric motor 16 mounted hidden inside the cabinet, so to be out of the way.

The hand-held unit comprises a streamlined case 17 supporting a first shaft 18 in bearings 19, the shaft having coupling means 20 at one end for attaching to an end 21 of the flexible shaft 15. The opposite end of the shaft 18 has a level gear 22 secured thereto for engaging a bevel gear 23 on second shaft 24 supported in bearing 25. Alternately the bevel gears 22 and 23 may comprise toothless cones having friction surfaces for engaging each other.

The second shaft 24 is slidable axically for selective engagement of the gear 23 with the gear 22. The shaft 24 is slided by means of a lever 26 pivotable at one end about a fixed pin 27. A compression coil spring 28, bearing at one end against a shoulder 29 of the case 17 and bearing at etc. other end against an enlarged collar 30 affixed on shaft 24, serves to normally disengage the gears 22 and 23, while the lever serves to engage them.

The collar 30 protrudes outwardly of the case and includes a chuck opening 31 in which either of various scrubbing brushes 32 are selectively engageable, by detent or retractable key and heyway means as shown at 33. The brush 32 a shown in FIG. 2 may be a small head with abrasive surface. The large brush **32*b* shown in FIG. 4** may incorporate wire bristles. Thus also various scrubbing textures from coarse to fine, are provided, as well as shapes and sizes.

The receptacle 12 consists of a tube 34 extending through the counter top with shoulder 35 bearing against the countertop upper surface 36 while a nut 37 threadingly engages screw thread 38 of the tube and bears against the underside surface 39 of the counter top.

The flexible shaft 15 extends loosley through the central opening 40 of the tube 34.

The motor 16 has mounting pads 41 integral with the motor case so to receive mounting bolts 42 in order to mount the motor to a partition 43 inside the cabinet 14.

In operative use, it is now evident that the unit 11 can be readily grasped in a person's hand and lifted out of the receptacle 12 with the flexible shaft following behind. By squeezing the lever toward the case held in the hand, the motor is turned on and the gears 22 and 23 engage so to rotate the brush.

As shown in FIG. 2 the shafts 18 and 24 may be at right angle to each other, or as shown in FIG. 3, a slightly different model of the unit has the shafts 18 and 24 at a diagonal angle respective to each other. Both models are otherwise identical mechanically.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A pots and pans scrubbing appliance, comprising in combination, a hand-held unit removably seated in a receptacle mounted through a countertop of a kitchen sink cabinet, a flexible shaft having one end connected to said unit, an electric motor mounted within an interior of said cabinet, an opposite end of said flexible shaft being attached to said motor; said unit including a case supporting therewithin a first shaft in bearings, one end of said first shaft being connected to said flexible shaft and an opposite end of said first shaft having a first gear secured thereupon, a second shaft in said case and slidably supported in bearings and being at an angle respective to said first shaft, one end of said second shaft having a gear secured thereupon, an opposite end of said second shaft having a collar secured thereto, said collar protruding outwardly of said case and having a chuck opening in an outward end thereof engaging selectively one of a plurality of brushes, a lever pivoted at one end inside said case and having a handle portion at an opposite end extending outwardly of said case, an intermediate portion of said lever bearing against an end of said second gear urging said second shaft to axially slide and said first and second gears to engage, and a compression spring between a shoulder of a partition inside said case and said collar normally urging said second shaft to axially slide in an opposite direction and disengage said gears.

2. The combination as set forth in claim 1 wherein said brush comprises one of a set of brushes of different sizes and shapes for scraping charred foods from different types of pots and pans.

* * * * *